United States Patent [19]

Jamsa

[11] Patent Number: 4,554,750

[45] Date of Patent: Nov. 26, 1985

[54] APPARATUS FOR COLLECTING PEAT FROM A PEAT FIELD

[75] Inventor: Hannu Jamsa, Eurajoki, Finland

[73] Assignee: Satoturve Oy, Eurajoki, Finland

[21] Appl. No.: 669,732

[22] Filed: Nov. 8, 1984

Related U.S. Application Data

[63] Continuation of Ser. No. 488,143, Apr. 25, 1983, abandoned.

[30] Foreign Application Priority Data

Jun. 1, 1982 [FI] Finland ..... 821929

[51] Int. Cl.[4] ..... E21C 49/00

[52] U.S. Cl. ..... 37/3; 44/28; 198/689.1

[58] Field of Search ..... 37/3, 195, DIG. 8; 44/27-33; 299/7-9; 198/689; 56/7, DIG. 8

[56] References Cited

U.S. PATENT DOCUMENTS

| | | | |
|---|---|---|---|
| 2,130,116 | 9/1938 | Blydenburgh | 56/7 |
| 2,827,749 | 3/1958 | Patten | 56/DIG. 8 |
| 2,837,042 | 6/1958 | Laval, Jr. | 198/689 X |
| 2,920,355 | 1/1960 | Clark | 198/689 X |
| 3,139,972 | 7/1964 | Kochalski | 198/689 |
| 3,395,467 | 8/1968 | Allen et al. | 37/195 |
| 3,776,593 | 12/1973 | Kuhlmann-Schaefer et al. | 299/8 |
| 4,207,907 | 6/1980 | Dyett | 198/689 X |

FOREIGN PATENT DOCUMENTS

| | | | |
|---|---|---|---|
| 875191 | 4/1953 | Fed. Rep. of Germany | 37/3 |
| 37-4007 | 6/1962 | Japan | 299/8 |
| 1042399 | 9/1966 | United Kingdom | 198/689 |
| 217361 | 8/1968 | U.S.S.R. | 37/3 |
| 759438 | 8/1980 | U.S.S.R. | 198/689 |
| 825970 | 4/1981 | U.S.S.R. | 37/3 |

*Primary Examiner*—Clifford D. Crowder
*Attorney, Agent, or Firm*—Joseph E. Mueth

[57] ABSTRACT

A method of collecting peat from peat field by loosening peat from a peat field in layers, characterized in that the peat to be picked up is loosened from its bed by fastening it to a filter surface by means of negative pressure and the peat is removed from the filter surface after the displacement of uplifting of said surface. A method wherein peat is removed from the filter surface by means of positive pressure. A method wherein the peat layer that is fastened to the filter surface and in which the top and bottom layers are not mixed with each other is sheared into a top and a bottom layer and the bottom layer is allowed to drop back on the field. An apparatus for collecting peat from a peat field wherein the apparatus comprises a body supported by wheels and/or rollers, and loosening means for loosening a peat layer from a peat field, wherein the loosening means comprises a drum coated with a filter material which is provided with perforations and has a negative pressure chamber therein.

10 Claims, 2 Drawing Figures

1
2
3
4
5
6
7
8
9

APPARATUS FOR COLLECTING PEAT FROM A PEAT FIELD

This application is a continuation of application Ser. No. 488,143, filed Apr. 25, 1983, now abandoned.

BACKGROUND OF THE INVENTION

The present invention relates to a method of and an apparatus for collecting milled peat in layers from a peat field. By means of the method and apparatus the dried surface portion of a loosened peat layer can be collected.

The methods heretofore known for the collection of dried milled peat from a production field include either collecting by the suction fan principle from the surface of a field of piling up the dried peat with bevelled mechanical buffer plates or a brush device to form a window, and proceeding thereafter with various methods. Such equipment at least partially agitate the peat layer in vertical direction, the drier surface portion and the lower moister peal layer mixing with each other.

With the apparatus of the invention, collection of milled peat can be started sooner than in the prior art methods after the beginning of a dry weather period, since the apparatus collects the peat layer vertically in the succession it lays on the surface of a field. Thus, a dry layer can be recovered and a moister layer sheared off back on the surface of a field for drying. It compared with a conventional vacuum or suction collector, the power demand of the present apparatus is lower. Advantages of the invention can be said to include energy savings and the fact that annual hectare yields increase.

SUMMARY OF THE INVENTION

Briefly, this invention comprises a method of collecting peat from a peat field by loosening peat from a peat field in layers, characterized in that the peat to be picked up is loosened from its bed by fastening it to a filter surface by means of negative pressure and the peat is removed from the filter surface after the displacement or uplifting of said surface.

This invention further comprises an apparatus for collecting peat from a peat field whereby the apparatus comprises a body supported by wheels and/or rollers, and loosening means for loosening a peat layer from a peat field, characterized in that the loosening means comprises a drum coated with a filter material which is provided with perforations and has a negative pressure chamber therein.

It is an object of this invention to provide a new method for collecting milled peat in layers in a manner that the mixing of the layers can be avoided.

It is also an object of this invention to provide a novel apparatus for collecting milled peat in layers without mixing of the layers.

These and other objects and advantages of this invention will be apparent from the detailed description which follows, taken in conjunction with the accompanying drawings.

DESCRIPTION OF THE PREFERRED EMBODIMENTS

The peat is normally loosened from a peat field in layers. A problem to be resolved has been how to avoid mixing of the drier surface portion and the lower moister peat layer together. To resolve this problem, it has now been discovered that the peat to be lifted is loosened from its bed by fastening it to a filter surface by means of negative pressure followed by removing the peat from said filter surface after the displacement of uplifting by means of positive pressure. The apparatus of this invention is provided with peat layer loosening means comprising a drum 1 coated with a filter material 8 and provided with perforations and internally divided into negative and positive pressure chambers 2 and 3. The peat layer that is fastened to the filter surface 8 can be sheared to form a top and a bottom layer, whereby the bottom layer can be allowed to drop back on the field to dry.

Figure 1:
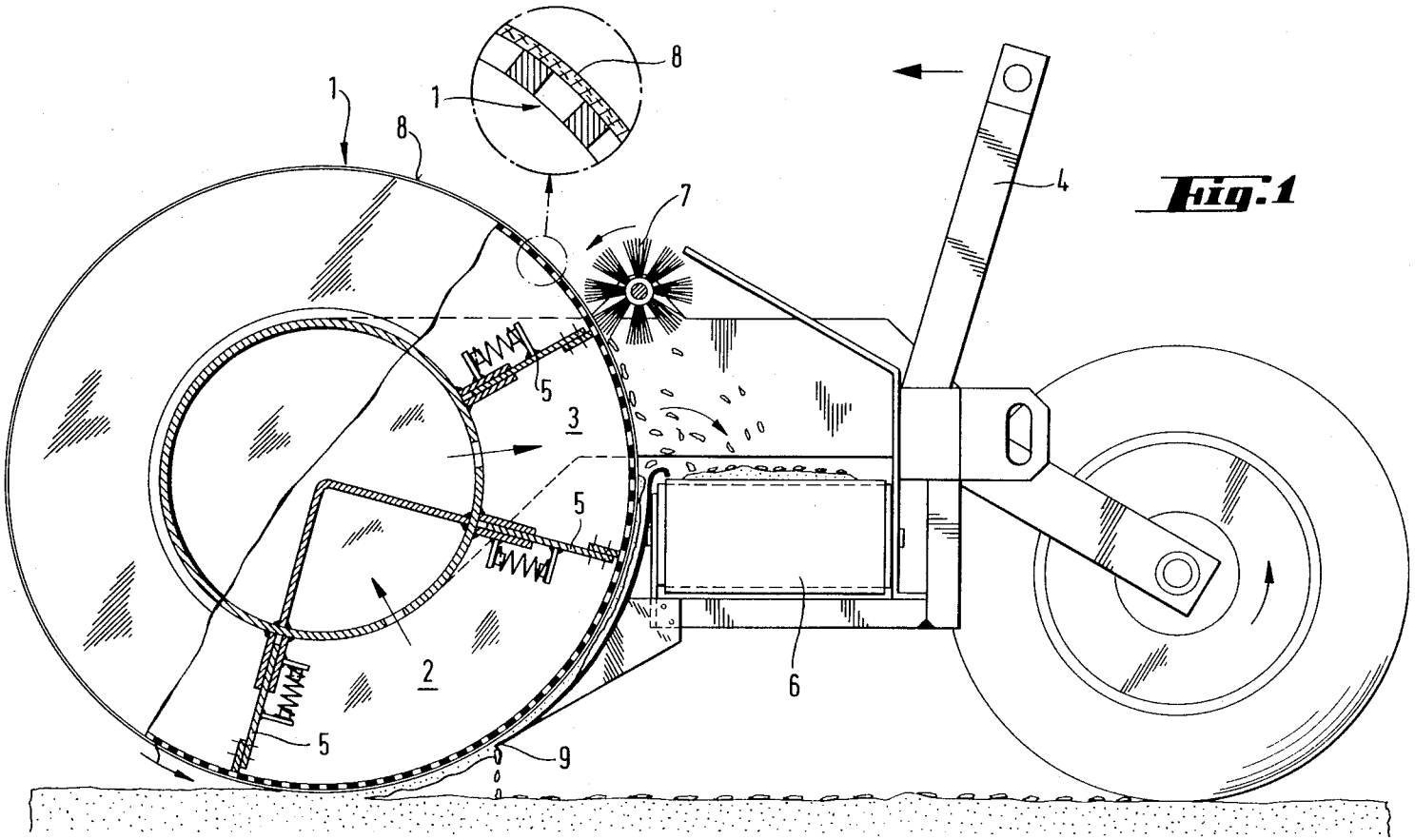
Figure 2:
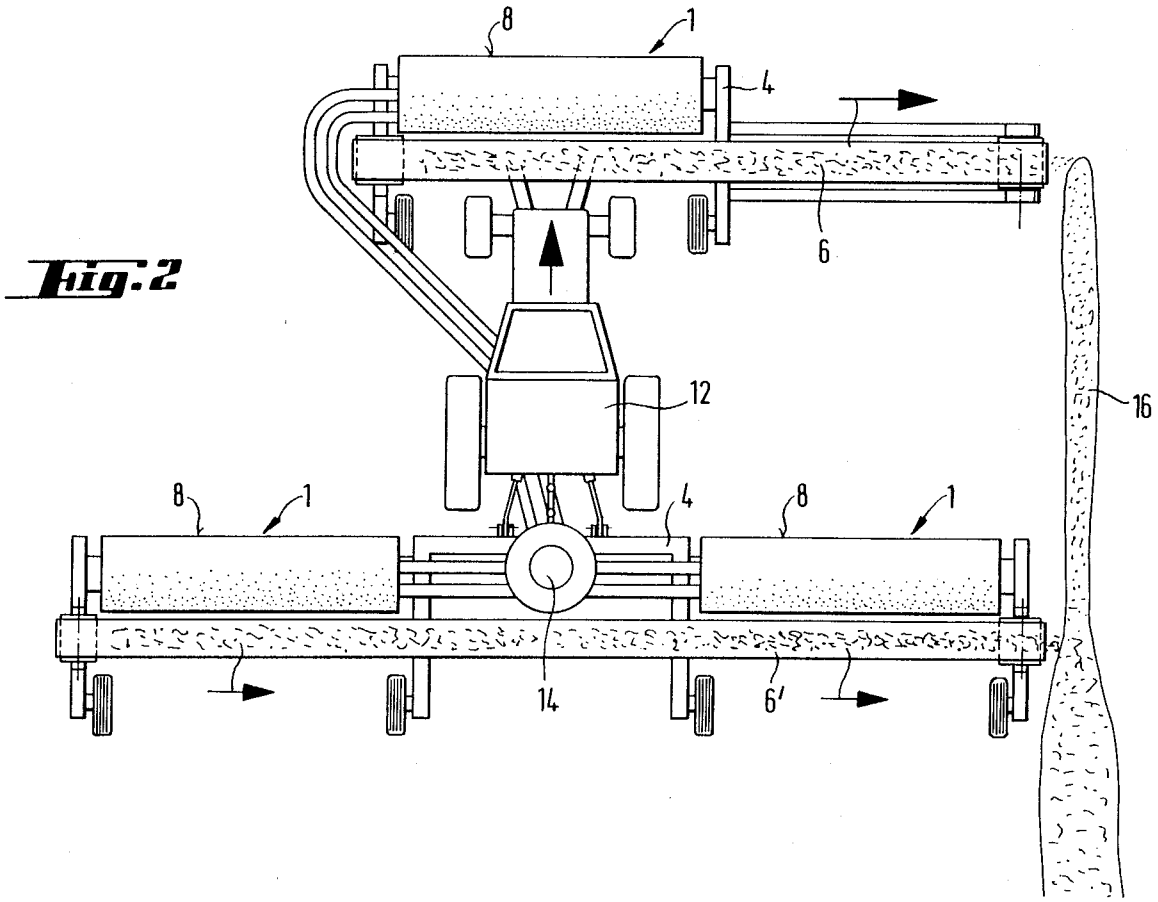

Following now is a more detailed description of a few embodiments of the invention with reference made to the accompanying drawings, in which:

FIG. 1 is a schematic side view of the first embodiment of an apparatus of the invention, and FIG. 2 is a plan view of the second embodiment of an apparatus of the invention.

The apparatus illustrated in FIG. 1 comprises a cylindrical drum 1 which runs upon a peat layer and is made of a perforated material and coated with a filter material layer 8 (e.g. a fibrous fabric). The cylindrical drum 1 is internally divided into negative and positive pressure chambers 2, 3 which, in the case of a cylindrical drum, are in the form of sectors. A cylindrical drum 1 can naturally be replaced by a roller mat whose shape is different from cylindrical. The cylindrical drum 1 is mounted for free rotation around a pipe shaft secured to a body member 4. Partitions 5 confining said negative and positive pressure chambers 2 and 3 are secured to a non-rotatable central pipe, through which the negative and positive pressure can be brought in the negative and positive pressure sectors 2 and 3. Partitions 5 are movable and are pressed by the action of a spring force or the like against the inner and end surfaces of a cylindrical drum, thus sealing these sectors.

The apparatus is also provided with a transverse conveyor 6 which transports the peat loosened and lifted by drum 1 aside to form a window or onto a vehicle.

A brush or a scraper 7 sweeps the surface of filter material 8.

The body member 4 of said apparatus, to which the cylindrical drum is journalled and the conveyor and the brush attached, facilitates mounting of the apparatus on a power machine.

The apparatus is further provided with an air manifold and a blower 14 shown in FIG. 2 for creating the necessary pressure differences within the cylindrical drum 1.

The apparatus operates so that negative pressure chamber 2 of cylindrical drum 1 loosens and fastens a layer of peat to the surface of filter material 8 and lifts a cutter 9 for shearing the bottom portion of said layer back on the field. The dry peat travels in vacuum engagement to the proximity of conveyor 6. The positive pressure chamber 3 of cylindrical drum 1 removes said peat from the surface of filter material 8 and transfers it on to conveyor 6. Instead of positive pressure, the peat can also be removed mechanically, e.g. by means of a brush.

The internal design and operation of the apparatus shown in FIG. 2 corresponds to the apparatus of FIG. 1 with the exception that one cylindrical drum 1 is disposed in front of a power machine 12 and two other cylindrical drums 1 are disposed behind said power machine 12, so that the working width obtained will be approximately three times that of a single cylindrical drum. All three cylindrical drums are connected by air manifolds or ducts to a common blower 14 mounted behind the power machine. Conveyors 6 and 6' are arranged in a manner that the uplifted peat can be transported beyond the working width to form a windrow 16 or onto a vehicle.

Having fully described the invention, it is intended that it be limited only by the lawful scope of the appended claims.

I claim:

1. A mobile vehicular-type apparatus for rolling over and collecting peat from a peat field ccmprising:

a body;

wheels or rollers supporting said body;

a power machine for propelling said apparatus over a peat field;

loosening means for loosening a peat layer from a peat field, said loosening means being rotatably journalled to said body and comprising at least one cylindrical drum having perforations and being adapted to exert the force of gravity as it rolls over the surface of a peat field, said drum carrying around its periphery a filter material which bridges said perforations;

said cylindrical drum having an internal negative pressure chamber formed by radially disposed, movable air tight partitions biased against the interior surface of said drum, said partitions being non-rotatable so that said filter material is sequentially brought into and out of communication with said negative pressure chamber, said negative pressure chamber being maintained in proximity to said peat layer as said drum rolls over the surface of the peat field, said filter material being a fibrous fabric which prevents the suction of peat particles and dust into said negative pressure chamber;

means for establishing a vacuum within said negative pressure chamber, said negative pressure chamber being effective to loosen from the field and fasten a layer of peat to the surface of said filter material by suction exerted on said filter material through said perforations;

means for removing said layer of peat from the surface of said filter material comprising a brush;

a cutter blade mounted in proximity to said filter material for shearing a peat layer fastened to said filter material into an inner and outer layer;

whereby said cutter blade shears the layer of peat held on the filter material so that said outer layer is sheared off and returned to the field and said inner layer is carried into proximity to said means for removing where it is removed from said filter material for recovery.

2. The apparatus of claim 1 wherein said partitions are spring biased against the interior surface of said drum.

3. An apparatus as set forth in claim 1 wherein said loosening means includes one loosening drum mounted in front of said power machine and two other loosening drums mounted behind said power machine laterally of the working width of the first mentioned drum in a manner that the total working width is approximately three times that of a single loosening drum.

4. The apparatus of claim 3 wherein a blower is mounted behind said power machine and said individual loosening drums are connected by air ducts to said blower.

5. The apparatus of claim 1 wherein peat conveyors are provided adjacent to said filter material, the lateral extent of said conveyors being such that said inner layer of uplifted peat is transported beyond the working width to form a windrow or onto a vehicle.

6. A mobile vehicular-type apparatus for collecting peat from a peat field comprising:

a body;

wheels or rollers supporting said body;

a power machine for propelling said apparatus over a peat field;

loosening means for loosening a peat layer from a peat field, said loosening means being rotatably journalled to said body and comprising at least one cylindrical drum having perforations and being adapted to exert the force of gravity as it rolls over the surface of a peat field, said drum carrying around its periphery a filter material which bridges said perforations;

said cylindrical drum having an internal negative pressure chamber formed by radially disposed, movable air tight partitions biased against the interior surface of said drum, said partitions being non-rotatable so that said filter material is sequentially brought into and out of communication with said negative pressure chamber, said negative pressure chamber being maintained in proximity to said peat layer as said drum rolls over the surface of the peat field, said filter material being a fibrous fabric which prevents the suction of peat particles and dust into said negative pressure chamber;

means for establishing a vacuum within said negative pressure chamber, said negative pressure chamber being effective to loosen from the field and fasten a layer of peat to the surface of said filter material by suction exerted on said filter material through said perforations;

means for removing said layer of peat from the surface of said filter material comprising a positive pressure chamber which is disposed internally of said drum and separated from said negative pressure chamber by said radially disposed air tight partitions, so that said filter material is sequentially brought into proximity to said negative and positive pressure chambers;

a cutter blade mounted in proximity to said filter material for shearing a peat layer fastened to said filter material into an inner and outer layer;

whereby said cutter blade shears the layer of peat held on the filter material so that said outer layer is sheared off and returned to the field and said inner layer is carried into proximity to said means for removing where it is removed from said filter material for recovery.

7. The apparatus of claim 6 wherein said partitions are spring biased against the interior surface of said drum.

8. An apparatus as set forth in claim 6 wherein said loosening means includes one loosening drum mounted in front of said power machine and two other loosening drums mounted behind said power machine laterally of the working width of the first mentioned drum in a manner that the total working width is approximately three times that of a single loosening drum.

9. The apparatus of claim 8 wherein a blower is mounted behind said power machine and said individual loosening drums are connected by air ducts to said common blower.

10. The apparatus of claim 6 wherein peat conveyors are provided adjacent to said filter material, the lateral extent of said conveyors being such that the said inner layer of uplifted peat is transported beyond the working width to form a windrow or onto a vehicle.

* * * * *